US009374651B2

(12) United States Patent
Jin et al.

(10) Patent No.: US 9,374,651 B2
(45) Date of Patent: Jun. 21, 2016

(54) SENSITIVITY CALIBRATION METHOD AND AUDIO DEVICE

(71) Applicant: Huawei Technologies Co., Ltd., Shenzhen (CN)

(72) Inventors: Jian Jin, Shenzen (CN); Zhendong Gao, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 151 days.

(21) Appl. No.: 14/201,125

(22) Filed: Mar. 7, 2014

(65) Prior Publication Data

US 2014/0321655 A1 Oct. 30, 2014

(30) Foreign Application Priority Data

Apr. 28, 2013 (CN) ..... 2013 1 0157556

(51) Int. Cl.
*H04R 29/00* (2006.01)
*H04R 3/00* (2006.01)

(52) U.S. Cl.
CPC ..... *H04R 29/004* (2013.01); *H04R 3/005* (2013.01); *H04R 2410/05* (2013.01); *H04R 2499/11* (2013.01)

(58) Field of Classification Search
CPC .. H04R 29/004; H04R 3/005; H04R 2410/05; H04R 2499/11
USPC ..... 381/58, 71.1–71.12, 111, 122
See application file for complete search history.

(56) References Cited

U.S. PATENT DOCUMENTS

2013/0156224 A1* 6/2013 Keane ..... H04R 3/04 381/97

FOREIGN PATENT DOCUMENTS

| | | | |
|---|---|---|---|
| CN | 101911723 | A | 12/2010 |
| CN | 102376309 | A | 3/2012 |
| CN | 102456341 | A | 5/2012 |
| JP | 2006074409 | A | 3/2006 |

* cited by examiner

*Primary Examiner* — Xu Mei
*Assistant Examiner* — Ammar Hamid
(74) *Attorney, Agent, or Firm* — Slater Matsil, LLP

(57) ABSTRACT

Embodiments of the present invention disclose a sensitivity calibration method and an audio device. The method of the present invention includes determining whether a first signal captured in a current frame by a primary capture module is a circuit noise. When the first signal is not a circuit noise, if the first signal has a stationary noise characteristic, a first calibration gain is determined according to the first signal and a second signal captured in the current frame by a secondary capture module. The second signal is calibrated according to the first calibration gain, so that sensitivity of the primary capture module is consistent with sensitivity of the secondary capture module.

14 Claims, 7 Drawing Sheets

SENSITIVITY CALIBRATION METHOD AND AUDIO DEVICE

CROSS-REFERENCE TO RELATED APPLICATION

This application claims priority to Chinese Patent Application No. 201310157556.7, filed on Apr. 28, 2013, which is hereby incorporated by reference in its entirety.

TECHNICAL FIELD

The present invention relates to the field of calibration, and in particular, to a sensitivity calibration method and an audio device.

BACKGROUND

In voice communication of a mobile phone, a main purpose of noise suppression is to suppress environmental noises, so that a wanted voice of a mobile phone user becomes clearer. The environmental noises are classified into stationary noises and non-stationary noises. Wanted voices are generally non-stationary.

A noise suppression method includes: single-microphone (microphone) noise reduction and dual-microphone noise reduction. Single-microphone noise reduction suppresses stationary noises in environmental noises by detecting stationarity of voice signals captured by a microphone, but can hardly suppress non-stationary noises such as speech of people nearby. Dual-microphone noise reduction reduces noises by installing two microphones at specific positions in a mobile phone and using reception differences between voices and environmental noises of dual microphones. Dual-microphone noise reduction not only suppresses stationary noises desirably, but also suppresses non-stationary noises more effectively. Therefore, dual-microphone noise reduction is applied to more and more mobile phones.

The reception differences between voices and environmental noises of dual microphones include: a phase difference, an energy difference, and so on, where the energy difference is an important characteristic that is used frequently. In normal use of a mobile phone, if a microphone close to a lower part of the mobile phone is referred to as a primary microphone, and the other microphone is referred to as a secondary microphone, the energy difference is represented as follows: Because the distance between the primary microphone and a wanted voice source is different from the distance between the secondary microphone and the wanted voice source, energy of wanted voices received by the primary microphone is higher than energy of wanted voices received by the secondary microphone; because the distance between the primary microphone and a noise source is basically the same as the distance between the secondary microphone and the noise source, energy of environmental noises received by the primary microphone is basically the same as energy of environmental noises received by the secondary microphone. The energy difference may be used to distinguish wanted voice signals from environmental noises. Specifically, if energy of a same voice signal captured by the primary microphone and the secondary microphone at the same time is basically the same, the voice signal may be considered as an environmental noise; otherwise, it is considered as a wanted voice signal; further, the purpose of noise reduction is achieved by removing the environmental noise.

In a process of implementing dual-microphone noise reduction, it is found that the prior art has at least the following problems: When an energy difference between wanted voices and environmental noises received by dual microphones is used to distinguish wanted voices from environmental noises, it is required that sensitivity of the primary microphone should be strictly consistent with sensitivity of the secondary microphone. However, in an actual use process, aging, blockage, malfunction, and so on of the microphones may cause inconsistent sensitivity of the primary microphone and the secondary microphone, and further deteriorate the effect of dual-microphone noise reduction.

SUMMARY

Embodiments of the present invention provide a sensitivity calibration method and an audio device, where the audio device includes a primary capture module and a secondary capture module, and is used to calibrate sensitivity of the primary capture module and the secondary capture module, improve consistency of sensitivity between the two modules, and further improve a noise reduction effect.

To achieve the foregoing objective, embodiments of the present invention adopt the following technical solutions:

According to a first aspect, a sensitivity calibration method is provided, and applied to an audio device, where the audio device includes a primary capture module and a secondary capture module, and the method includes:

determining whether a first signal captured in a current frame by the primary capture module is a circuit noise;

when the first signal is not a circuit noise, if the first signal has a stationary noise characteristic, determining a first calibration gain according to the first signal and a second signal captured in the current frame by the secondary capture module; and calibrating the second signal according to the first calibration gain, so that sensitivity of the primary capture module is consistent with sensitivity of the secondary capture module.

With reference to the first aspect, in a first possible implementation manner, the determining whether a first signal captured by the primary capture module is a circuit noise includes:

obtaining a first characteristic value of the first signal, and comparing the first characteristic value with a preset circuit noise threshold, and if the first characteristic value is greater than the circuit noise threshold, determining that the first signal is not a circuit noise, or otherwise, determining that the first signal is a circuit noise, where the first characteristic value includes: an average amplitude value, or a square root of average energy.

With reference to the first aspect or the first possible implementation manner of the first aspect, in a second possible implementation manner, the determining a first calibration gain according to the first signal and a second signal captured by the secondary capture module includes:

determining the first calibration gain according to a ratio of the first characteristic value of the first signal to a second characteristic value of the second signal.

With reference to the first aspect or the first possible implementation manner of the first aspect, in a third possible implementation manner, the determining a first calibration gain according to the first signal and a second signal captured by the secondary capture module includes:

determining a preliminary calibration gain according to a ratio of the first characteristic value of the first signal to a second characteristic value of the second signal; and performing a smooth update on the determined preliminary calibration gain on a time axis according to a preset smoothing factor, and obtaining the first calibration gain.

With reference to the third possible implementation manner of the first aspect, in a fourth possible implementation manner, the performing a smooth update on the determined preliminary calibration gain on a time axis according to a preset smoothing factor, and obtaining the first calibration gain include:

determining the first calibration gain according to a proportional relationship between a second calibration gain and the preliminary calibration gain, where if the current frame is the first frame, the second calibration gain is a preset value, or if the current frame is not the first frame, the second calibration gain is a first calibration gain determined in a previous frame of the current frame.

With reference to the fourth possible implementation manner of the first aspect, in a fifth possible implementation manner, before the determining the first calibration gain according to a proportional relationship between a second calibration gain and the preliminary calibration gain, the method further includes: setting a first calibration gain range according to the second calibration gain; and the determining the first calibration gain according to a proportional relationship between a second calibration gain and the preliminary calibration gain includes:

obtaining an intermediate calibration gain according to the proportional relationship between the second calibration gain and the preliminary calibration gain; and if the intermediate calibration gain is within the first calibration gain range, use the intermediate calibration gain as the first calibration gain; or if the intermediate calibration gain is beyond the first calibration gain range, using a value, closest to the intermediate calibration gain, in the first calibration gain range as the first calibration gain.

With reference to any one of the second possible implementation manner to the fifth possible implementation manner of the first aspect, in a sixth possible implementation manner, the calibrating the second signal according to the first calibration gain, so that sensitivity of the primary capture module is consistent with sensitivity of the secondary capture module includes:

using a product of the second signal and the first calibration gain as the calibrated second signal.

With reference to the first aspect, in a seventh possible implementation manner, the method further includes:

when the first signal is a circuit noise, or when the first signal is not a circuit noise and the first signal does not have a stationary noise characteristic, calibrating the second signal according to a second calibration gain, where if the current frame is the first frame, the second calibration gain is a preset value, or if the current frame is not the first frame, the second calibration gain is a first calibration gain determined in a previous frame of the current frame.

According to a second aspect, an audio device is provided, where the audio device includes a primary capture module and a secondary capture module, the primary capture module is configured to capture a first signal, the secondary capture module is configured to capture a second signal, and the audio device further includes:

a circuit noise determining unit, configured to determine whether the first signal captured by the primary capture module is a circuit noise;

a gain calculating unit, configured to determine a first calibration gain according to the first signal and the second signal captured by the secondary capture module when the first signal is not a circuit noise if the first signal has a stationary noise characteristic; and a first calibrating unit, configured to calibrate the second signal according to the first calibration gain, so that sensitivity of the primary capture module is consistent with sensitivity of the secondary capture module.

With reference to the second aspect, in a first possible implementation manner, the circuit noise determining unit includes:

an obtaining module, configured to obtain a first characteristic value of the first signal;

a comparing module, configured to compare the first characteristic value with a preset circuit noise threshold, where the first characteristic value includes: an average amplitude value, or a square root of average energy; and a circuit noise determining module, configured to determine that the first signal is not a circuit noise if the first characteristic value is greater than the circuit noise threshold, or otherwise, determine that the first signal is a circuit noise.

With reference to the second aspect or the first possible implementation manner of the second aspect, in a second possible implementation manner, the gain calculating unit specifically includes: determining the first calibration gain according to a ratio of the first characteristic value of the first signal to a second characteristic value of the second signal.

With reference to the second aspect or the first possible implementation manner of the second aspect, in a third possible implementation manner, the gain calculating unit includes:

a preliminary calibration gain calculating module, configured to determine a preliminary calibration gain according to a ratio of the first characteristic value of the first signal to a second characteristic value of the second signal; and a smooth updating module, configured to perform a smooth update on the determined preliminary calibration gain on a time axis according to a preset smoothing factor, and obtain the first calibration gain.

With reference to the third possible implementation manner of the second aspect, in a fourth possible implementation manner, the smooth updating module is specifically configured to determine the first calibration gain according to a proportional relationship between a second calibration gain and the preliminary calibration gain, where if the current frame is the first frame, the second calibration gain is a preset value, or if the current frame is not the first frame, the second calibration gain is a first calibration gain determined in a previous frame of the current frame.

With reference to the fourth possible implementation manner of the second aspect, in a fifth possible implementation manner, the gain calculating unit further includes a gain range setting module, configured to set a first calibration gain range according to the second calibration gain; where the gain updating module is specifically configured to: obtain an intermediate calibration gain according to the proportional relationship between the second calibration gain and the preliminary calibration gain; and if the intermediate calibration gain is within the first calibration gain range, use the intermediate calibration gain as the first calibration gain; or if the intermediate calibration gain is beyond the first calibration gain range, use a value, closest to the intermediate calibration gain, in the first calibration gain range as the first calibration gain.

With reference to any one of the second possible implementation manner to the fifth possible implementation manner of the second aspect, in a sixth possible implementation manner, the first calibrating unit is specifically configured to use a product of the second signal and the first calibration gain as the calibrated second signal.

With reference to the second aspect, in a seventh possible implementation manner, the device further includes:

a second calibrating unit, configured to calibrate the second signal according to a second calibration gain when the first signal is a circuit noise, where if the current frame is the first frame, the second calibration gain is a preset value, or if the current frame is not the first frame, the second calibration gain is a first calibration gain determined in a previous frame of the current frame.

With reference to the second aspect, in an eighth possible implementation manner, the device further includes:

a third calibrating unit, configured to calibrate the second signal according to a second calibration gain when the first signal is not a circuit noise if the first signal does not have a stationary noise characteristic, where if the current frame is the first frame, the second calibration gain is a preset value, or if the current frame is not the first frame, the second calibration gain is a first calibration gain determined in a previous frame of the current frame.

With the sensitivity calibration method and audio device provided by the embodiments of the present invention, a first calibration gain is determined according to an obtained first signal captured in a current frame by a primary capture module and an obtained second signal captured in the current frame by a secondary capture module, and the second signal is calibrated according to the first calibration gain, so that calibration is implemented for the secondary capture module, consistency of sensitivity between the primary capture module and the secondary capture module is improved, and further, a noise reduction effect is improved, and the problem of an undesired noise reduction effect caused by inconsistency of sensitivity between a primary capture module and a secondary capture module in the prior art is solved.

DESCRIPTION OF EMBODIMENTS

The sensitivity calibration method and devices provided by embodiments of the present invention are hereinafter described in detail with reference to accompanying drawings.

The sensitivity calibration method and devices provided by the embodiments of the present invention may be applied to an audio device, where the audio device may include a primary capture module and a secondary capture module. Specifically, the method and devices may be applied to the audio device before a noise reduction operation is performed by using an energy difference between wanted signals and environmental noises received by the two capture modules; and of course, may be applied to other non-noise reduction operations that may improve performance of the audio device after sensitivity calibration is performed, which is not limited by the present invention.

The audio device may be a mobile phone, a recorder, a tablet computer, or any other intelligent terminal, which is equipped with at least two audio capture modules. The capture modules may be microphones, audio capture cards, acoustoelectric converters, and so on. When the audio device is equipped with more than two capture modules, the method of this embodiment may be used to perform sensitivity calibration for any two of the capture modules, so that sensitivity of the two capture modules is consistent; further, consistency of sensitivity between all capture modules is realized.

It should be noted that with respect to any two capture modules in an audio device, either may be used as a primary capture module, and the other is used as a secondary capture module. All the following embodiments are described by using a mobile phone equipped with two capture modules as an example. The primary capture module may be a primary microphone or a secondary microphone in the mobile phone. When the primary capture module is the primary microphone, the secondary capture module is the secondary microphone; conversely, when the primary capture module is the secondary microphone, the secondary capture module is the primary microphone. All the following embodiments are described by using an example in which the primary capture module is the primary microphone and the secondary capture module is the secondary microphone. Normally, in a mobile phone, a microphone close to a wanted sound source is used as a primary microphone, for example, a microphone close to the mouth of a mobile phone user is used as a primary microphone.

Figure 1:
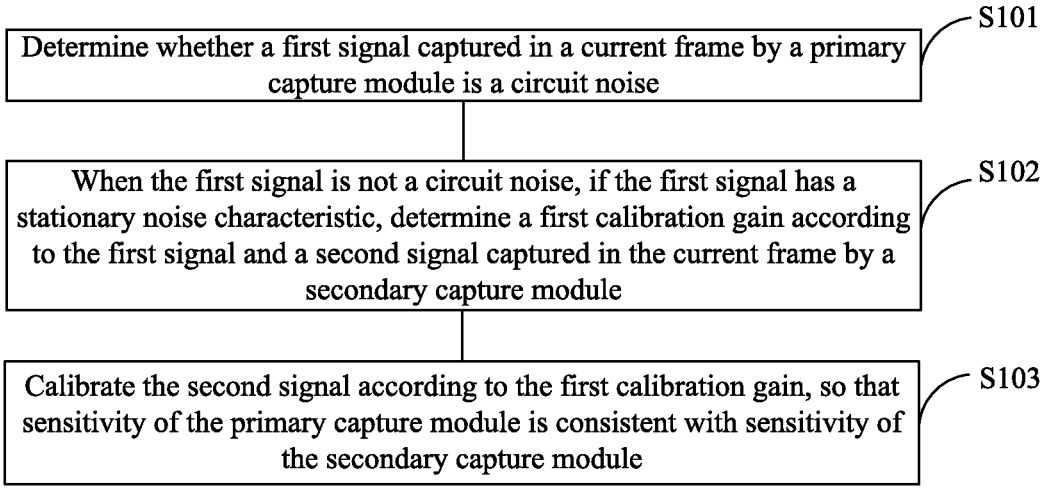
FIG. 1 is a flowchart of a sensitivity calibration method according to an embodiment of the present invention.

In one aspect, as shown in FIG. 1, an embodiment of the present invention provides a sensitivity calibration method applied to an audio device, where the audio device includes a primary capture module and a secondary capture module, and the method includes:

S101. Determine whether a first signal captured in a current frame by the primary capture module is a circuit noise.

Exemplarily, in voice processing, the number of sampling points within 20 ms is generally used as the duration of a frame.

Further, step S101 may include:

obtaining a first characteristic value of the first signal, and comparing the first characteristic value with a preset circuit noise threshold, and if the first characteristic value is greater than the circuit noise threshold, determining that the first signal is not a circuit noise, or otherwise, determining that the first signal is a circuit noise, where the first characteristic value includes: an average amplitude value, or a square root of average energy.

Exemplarily, the circuit noise threshold refers to the magnitude of a signal generated by a circuit of the audio device in the case of exterior silence. The circuit noise threshold is set according to a particular calibration algorithm, and its value is related to characteristics of the audio device. Generally, a preset circuit noise value is an average amplitude value. Therefore, the first characteristic value may include an average amplitude value, or a square root of average energy.

It should be noted that the embodiment of the present invention does not limit the method for determining whether the first signal is a circuit noise. For example, the method may further include: obtaining an average energy value of the first signal, and comparing the average energy value of the first signal with the square of the circuit noise threshold, and if the average energy value of the first signal is greater than the square of the circuit noise threshold, determining that the first signal is not a circuit noise, or otherwise, determining that the first signal is a circuit noise. For the method for obtaining a first calibration gain in this case, reference may be made to Embodiment 2.

S102. When the first signal is not a circuit noise, if the first signal has a stationary noise characteristic, determine a first calibration gain according to the first signal and a second signal captured in the current frame by the secondary capture module.

Further, the embodiment of the present invention does not limit the method for detecting whether the first signal has a stationary noise characteristic. For example, a common method for detecting a single-microphone voice activity may be used for detection. Common methods include pitch detection, short-time zero-crossing rate calculation, and so on.

(1) Optionally, the determining a first calibration gain according to the first signal and a second signal captured by the secondary capture module includes:

determining the first calibration gain according to a ratio of the first characteristic value of the first signal to a second characteristic value of the second signal.

Exemplarily, the first characteristic value of the first signal and the second characteristic value of the second signal are generally characteristic values of a same type. For example, the first characteristic value and the second characteristic value are both average amplitude values, or are both square roots of average energy.

(2) A preliminary calibration gain of the signal in the current frame, which is obtained according to (1), may be greatly different from a second calibration gain of a signal in a previous frame. To enhance stability of the audio device, in an actual application, the first calibration gain directly used for calibration in (1) may be used as a preliminary calibration gain, and further, a smooth update may be performed on the preliminary calibration gain. Therefore, the embodiment of the present invention provides the following options:

The determining a first calibration gain according to the first signal and a second signal captured by the secondary capture module may further include:

a. determining a preliminary calibration gain according to a ratio of the first characteristic value of the first signal to the second characteristic value of the second signal; and b. performing a smooth update on the determined preliminary calibration gain on a time axis according to a preset smoothing factor, and obtaining the first calibration gain.

Exemplarily, the embodiment of the present invention does not limit the smooth update method used in step b.

Optionally, step b may include: determining the first calibration gain according to a proportional relationship between the second calibration gain and the preliminary calibration gain, where if the current frame is the first frame, the second calibration gain is a preset value, or if the current frame is not the first frame, the second calibration gain is a first calibration gain determined in a previous frame of the current frame.

Exemplarily, if the preliminary calibration gain in the current frame is represented by h, and the second calibration gain is represented by h", the first calibration gain may be calculated by using: $a*h''+(1-a)*h$, where, a represents a smoothing factor, and $0 \le a \le 1$. A greater value of a represents a higher smooth degree and higher calibration stability of a secondary capture module, that is, the audio device is more stable; however, the convergence speed is relatively low. In an actual use process, the value of a may be determined according to an empirical value, the requirement for stability, the requirement for the convergence speed, and so on. For example, a may be set to 0.91. In addition, the initial value of h" may be set to 1.

To avoid the problem of calibration instability caused by a great difference between the obtained first calibration gain and the second calibration gain, further optionally, step b may further include:

b-1. setting a first calibration gain range according to the second calibration gain;

b-2. obtaining an intermediate calibration gain according to the proportional relationship between the second calibration gain and the preliminary calibration gain; and b-3. if the intermediate calibration gain is within the first calibration gain range, using the intermediate calibration gain as the first calibration gain; or if the intermediate calibration gain is beyond the first calibration gain range, using a value, closest to the intermediate calibration gain, in the first calibration gain range as the first calibration gain.

Exemplarily, if the second calibration gain is represented by h", the first calibration gain range set according to the second calibration gain is: [h"−step, h"+step], where, the step represents a step. In an actual use process, the size of the step may be determined according to an empirical value, the requirement for stability, the requirement for the convergence speed, and so on. For example, assuming that h" is 0.3 and the step is 0.1, it may be known that the first calibration gain range is [0.2, 0.4]. An intermediate calibration gain h' is obtained according to $h'=a*h''+(1-a)*h$. When the obtained h' is 0.15, because 0.15 is not within [0.2, 0.4], and a value, closest to 0.15, in [0.2, 0.4] is 0.2, 0.2 is used as the first calibration gain; similarly, when the obtained h' is 0.5, 0.4 is used as the first calibration gain; and when the obtained h' is 0.3, because 0.3 is within [0.2, 0.4], 0.3 is used as the first calibration gain.

S103. Calibrate the second signal according to the first calibration gain, so that sensitivity of the primary capture module is consistent with sensitivity of the secondary capture module.

Optionally, step S103 may include: using a product of the second signal and the first calibration gain as the calibrated second signal.

Exemplarily, the first signal remains unchanged, and the second signal is calibrated; that is, sensitivity of the primary capture module remains unchanged, and sensitivity of the secondary capture module is calibrated, so that sensitivity of the primary capture module is consistent with sensitivity of the secondary capture module.

Further, the method may further include:

when the first signal is a circuit noise, or when the first signal is not a circuit noise and the first signal does not have a stationary noise characteristic, calibrating the second signal according to a second calibration gain, where if the current frame is the first frame, the second calibration gain is a preset value, or if the current frame is not the first frame, the second calibration gain is a first calibration gain determined in a previous frame of the current frame.

Exemplarily, if the current frame is the first frame on the time axis, the current frame does not have a previous frame, and therefore, the second calibration gain may be a preset value, for example, may be an initial value 1; and if the current frame is not the first frame on the time axis, the second calibration gain may be a first calibration gain determined in the previous frame of the current frame. The calibrating the second signal according to the second calibration gain may include: using a product of the second signal and the second calibration gain as the calibrated second signal.

The sensitivity calibration method provided by the embodiment of the present invention is applied to an audio device, where the audio device includes a primary capture module and a secondary capture module. A first calibration gain is determined according to an obtained first signal captured in a current frame by the primary capture module and an obtained second signal captured in the current frame by the secondary capture module, and the second signal is calibrated according to the first calibration gain, so that calibration is implemented for the secondary capture module, consistency of sensitivity between the primary capture module and the secondary capture module is improved, and further, the noise reduction effect is improved, and the problem of an undesired noise reduction effect caused by inconsistency of sensitivity between a primary capture module and a secondary capture module in the prior art is solved.

The sensitivity calibration method is hereinafter described in detail with reference to two specific embodiments. The following two embodiments are both described by using an example in which capture modules included in an audio device are a primary microphone and a secondary microphone.

Embodiment 1

Figure 2:
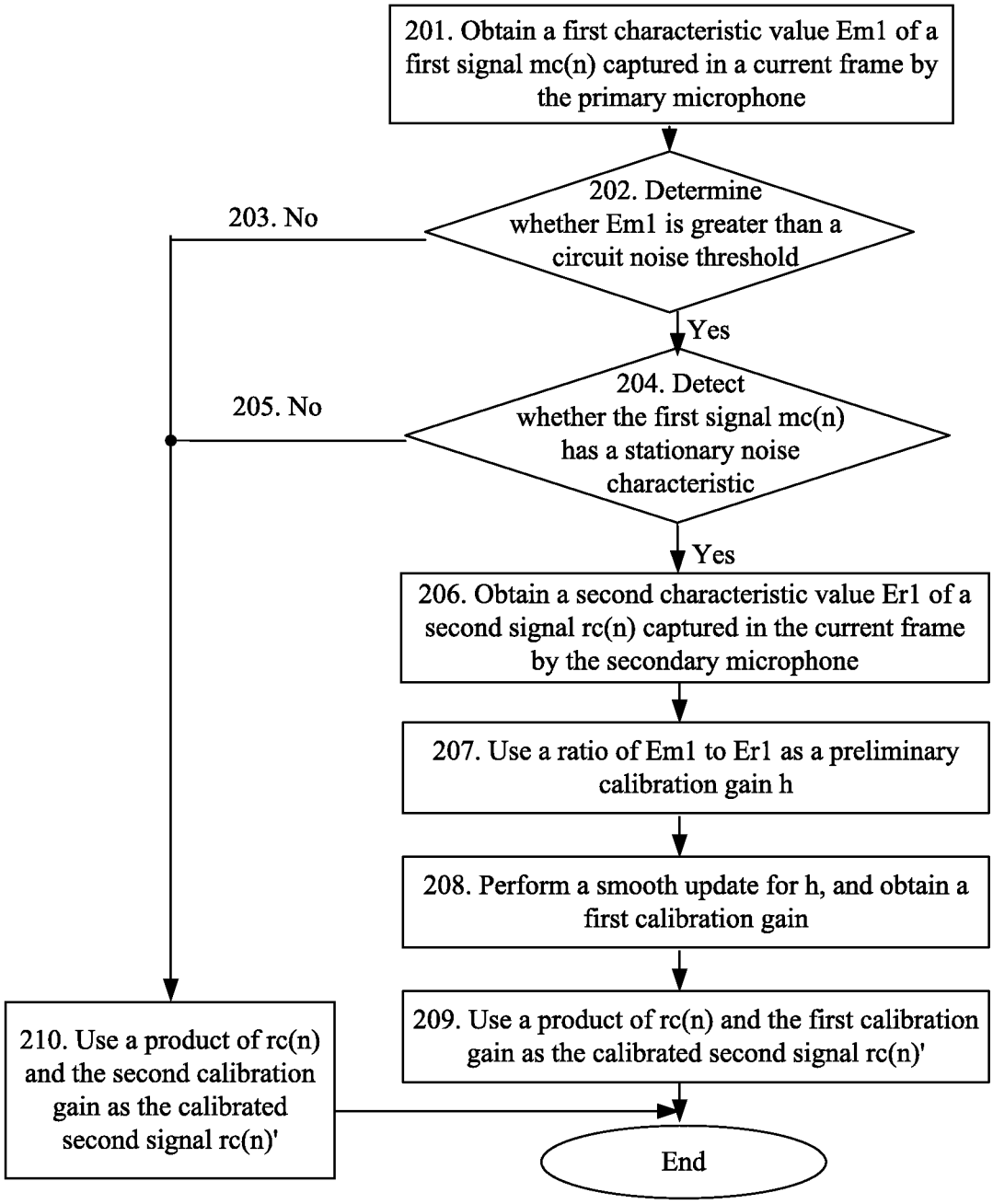
FIG. 2 is a flowchart of another sensitivity calibration method according to an embodiment of the present invention.

As shown in FIG. 2, a sensitivity calibration method is provided by the embodiment of the present invention and includes:

201. Obtain a first characteristic value Em1 of a first signal mc(n) captured in a current frame by a primary microphone.

The first characteristic value may include: an average amplitude value, or a square root of average energy. When the first characteristic value is an average amplitude value, a formula for calculating the first characteristic value of the first signal captured in the current frame by the primary microphone may be: Em1=sum(|mc(n)|)/N; and when the first characteristic value is a square root of average energy, a formula for calculating the first characteristic value of the first signal captured in the current frame by the primary microphone may be: $Em1=\sqrt{sum(mc(n)*mc(n))/N}$, where, sum( ) represents summation, mc(n) represents an $n^{th}$ signal captured in the current frame by the primary microphone, the value range of n is related to the total number of signals captured in the current frame by the primary microphone, and N represents the total number of signals captured in the current frame.

202. Determine whether Em1 is greater than a circuit noise threshold.

The circuit noise threshold is generally an amplitude value, and may be pre-stored in the audio device.

203. If Em1 is not greater than the circuit noise threshold, perform step 210.

204. If Em1 is greater than the circuit noise threshold, detect whether the first signal mc(n) has a stationary noise characteristic.

205. If the first signal mc(n) does not have a stationary noise characteristic, perform step 210.

206. If the first signal mc(n) has a stationary noise characteristic, obtain a second characteristic value Er1 of a second signal rc(n) captured in the current frame by a secondary microphone.

When the first characteristic value is an average amplitude value, the second characteristic value is an average amplitude value, and a formula for calculating the second characteristic value of the second signal captured in the current frame by the secondary microphone may be: Er1=sum(|rc(n)|)/N; and when the first characteristic value is a square root of average energy, the second characteristic value is a square root of average energy, and a formula for calculating the second characteristic value of the second signal captured in the current frame by the secondary microphone may be: $Er1=\sqrt{sum(rc(n)*rc(n))/N}$, where, sum( ) represents summation, rc(n) represents an $n^{th}$ signal captured in the current frame by the secondary microphone, the value range of n is related to the total number of signals captured in the current frame by the secondary microphone, and N represents the total number of signals captured in the current frame.

207. Use a ratio of Em1 to Er1 as a preliminary calibration gain h.

208. Perform a smooth update on h, and obtain a first calibration gain.

Step 208 may include: (1) obtaining an intermediate calibration gain according to the formula h'=a*h"+(1−a)*h, where h' represents the intermediate calibration gain, a represents a smoothing factor, and h" represents a second calibration gain; and (2) obtaining the first calibration gain according to the intermediate calibration gain and a set first calibration gain range. For details, reference may be made to the foregoing embodiment.

209. Use a product of rc(n) and the first calibration gain as the calibrated second signal rc(n)'.

Calibrated second signal rc(n)'=First calibration gain*rc(n); the first signal mc(n) remains unchanged.

210. Use a product of rc(n) and the second calibration gain as the calibrated second signal rc(n)'.

If the current frame is the first frame, the second calibration gain is a preset value, for example, may be an initial value 1; or if the current frame is not the first frame, the second calibration gain is a first calibration gain obtained in a previous frame of the current frame. Calibrated second signal rc(n)'=Second calibration gain*rc(n); the first signal mc(n) remains unchanged.

It should be noted that in a specific implementation process, the second calibration gain may be stored, and used to perform a smooth update on the preliminary calibration gain of the current frame, or used to calibrate the second signal in step 210.

For the purpose of reducing calculation steps, because the first calibration gain obtained in step 207 is the ratio of Em1 to Er1, in a specific implementation, a sum of absolute values of the first signal may be obtained in step 201, and a sum of absolute values of the second signal may be obtained in step 206, and an averaging operation is not performed.

The sensitivity calibration method provided by the embodiment of the present invention is applied to an audio device, where the audio device includes a primary microphone and a secondary microphone. A first calibration gain is determined according to an obtained first signal captured in a current frame by the primary microphone and an obtained second signal captured in the current frame by the secondary microphone, and the second signal is calibrated according to the first calibration gain, so that calibration is implemented for the secondary microphone, consistency of sensitivity between the primary microphone and the secondary microphone is improved, further, the noise reduction effect is improved, and the problem of an undesired noise reduction effect caused by inconsistency of sensitivity between a primary microphone and a secondary microphone in the prior art is solved.

Embodiment 2

Figure 3:
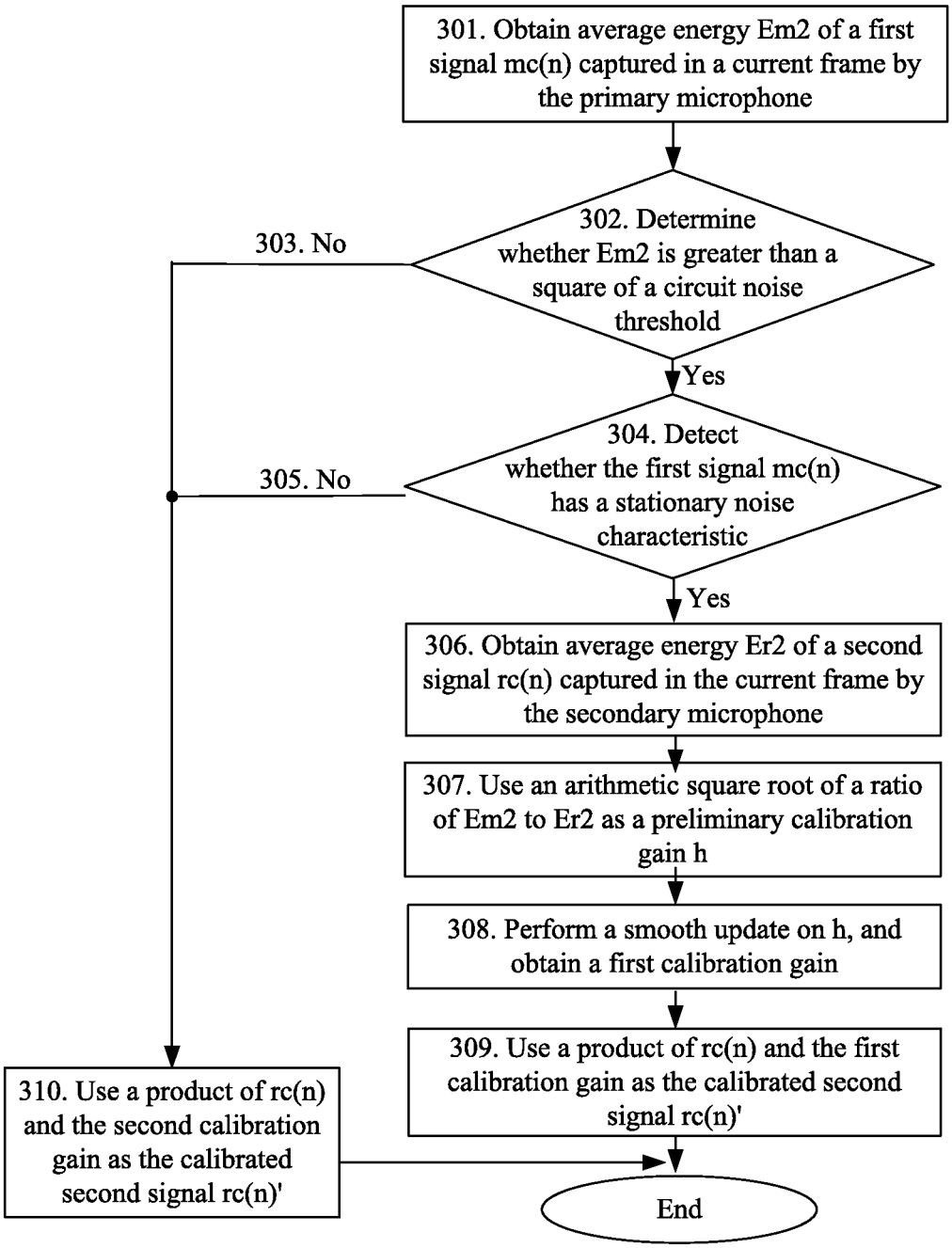
FIG. 3 is a flowchart of another sensitivity calibration method according to an embodiment of the present invention.

As shown in FIG. 3, a sensitivity calibration method is provided by the embodiment of the present invention and includes:

301. Obtain average energy Em2 of a first signal mc(n) captured in a current frame by a primary microphone.

A formula for calculating the average energy of the first signal mc(n) captured in the current frame by the primary microphone may be Em2=sum(mc(n)*mc(n))/N, where, sum( ) represents summation, mc(n) represents an $n^{th}$ signal captured in the current frame by the primary microphone, the value range of n is related to the total number of signals captured in the current frame by the primary microphone, and N represents the total number of signals captured in the current frame.

302. Determine whether Em2 is greater than the square of a circuit noise threshold.

Because the average energy is obtained in step 301, and the circuit noise threshold is generally an amplitude value, it is necessary to perform a square operation on the circuit noise threshold, and further determine whether the first signal is not a circuit noise.

303. If Em2 is not greater than the square of the circuit noise threshold, perform step 310.

304. If Em2 is greater than the square of the circuit noise threshold, detect whether the first signal mc(n) has a stationary noise characteristic.

305. If the first signal mc(n) does not have a stationary noise characteristic, perform step 310.

306. If the first signal mc(n) has a stationary noise characteristic, obtain average energy Er2 of a second signal rc(n) captured in the current frame by the secondary microphone.

A formula for calculating the average energy of the second signal rc(n) captured in the current frame by the secondary microphone may be: Er2=sum(rc(n)*rc(n))/N, where, sum( ) represents summation, rc(n) represents an $n^{th}$ signal captured in the current frame by the secondary microphone, the value range of n is related to the total number of signals captured in the current frame by the secondary microphone, and N represents the total number of signals captured in the current frame.

307. Use an arithmetic square root of a ratio of Em2 to Er2 as a preliminary calibration gain h.

308. Perform a smooth update on h, and obtain a first calibration gain.

For the detailed step of the smooth update, reference may be made to step 208 of Embodiment 1.

309. Use a product of rc(n) and the first calibration gain as the calibrated second signal rc(n)'.

Calibrated second signal rc(n)'=First calibration gain*rc(n); the first signal mc(n) remains unchanged.

310. Use a product of rc(n) and the second calibration gain as the calibrated second signal rc(n)'.

If the current frame is the first frame, the second calibration gain is a preset value, for example, may be an initial value 1; or if the current frame is not the first frame, the second calibration gain is a first calibration gain obtained in a previous frame of the current frame. Calibrated second signal rc(n)'=Second calibration gain*rc(n); the first signal mc(n) remains unchanged.

It should be noted that in a specific implementation process, the second calibration gain may be stored, and used to perform a smooth update on the preliminary calibration gain of the current frame, or used to calibrate the second signal in step 310.

For the purpose of reducing calculation steps, because the first calibration gain obtained in step 307 is the ratio of Em1 to Er1, in a specific implementation, a sum of energy of the first signal may be obtained in step 301, and a sum of energy of the second signal may be obtained in step 306, and an averaging operation is not performed.

The sensitivity calibration method provided by the embodiment of the present invention is applied to an audio device, where the audio device includes a primary microphone and a secondary microphone. A first calibration gain is determined according to an obtained first signal captured in a current frame by the primary microphone and an obtained second signal captured in the current frame by the secondary microphone, and the second signal is calibrated according to the first calibration gain, so that calibration is implemented for the secondary microphone, consistency of sensitivity between the primary microphone and the secondary microphone is improved, further, the noise reduction effect is improved, and the problem of an undesired noise reduction effect caused by inconsistency of sensitivity between a primary microphone and a secondary microphone in the prior art is solved.

Further, the difference between Embodiment 1 and Embodiment 2 lies in that Embodiment 1 uses the average amplitude value of the signal as the magnitude of the signal, while Embodiment 2 uses the average energy of the signal as the magnitude of the signal. When the signal variation range is not large, effects of the two embodiments are basically the same. However, when the signal variation range is large, an error caused by the method used in Embodiment 2 is greater than an error caused by the method used in Embodiment 1, and in this case, the solution of Embodiment 1 is a preferred solution.

Embodiment 3

A method for applying the foregoing sensitivity calibration method is further provided by the embodiment of the present invention, and is applied to an audio device, and exemplarily, is specifically applied to an audio device in a noise reduction process. The audio device includes a primary microphone and a secondary microphone. Signals captured by the microphones include wanted voices and environmental noises. Because the distance between the primary microphone and a noise source is basically the same as the distance between the secondary microphone and the noise source, energy of the environmental noises received by the primary microphone is basically the same as energy of the environmental noises received by the secondary microphone. An energy difference may be used to distinguish wanted voices from environmental noises. Specifically, if energy of a same voice signal captured by the primary microphone and the secondary microphone at the same time is basically the same, the voice signal may be considered as an environmental noise; otherwise, it is considered as a wanted voice; further, the purpose of noise reduction is achieved by removing the environmental noise.

Figure 4:
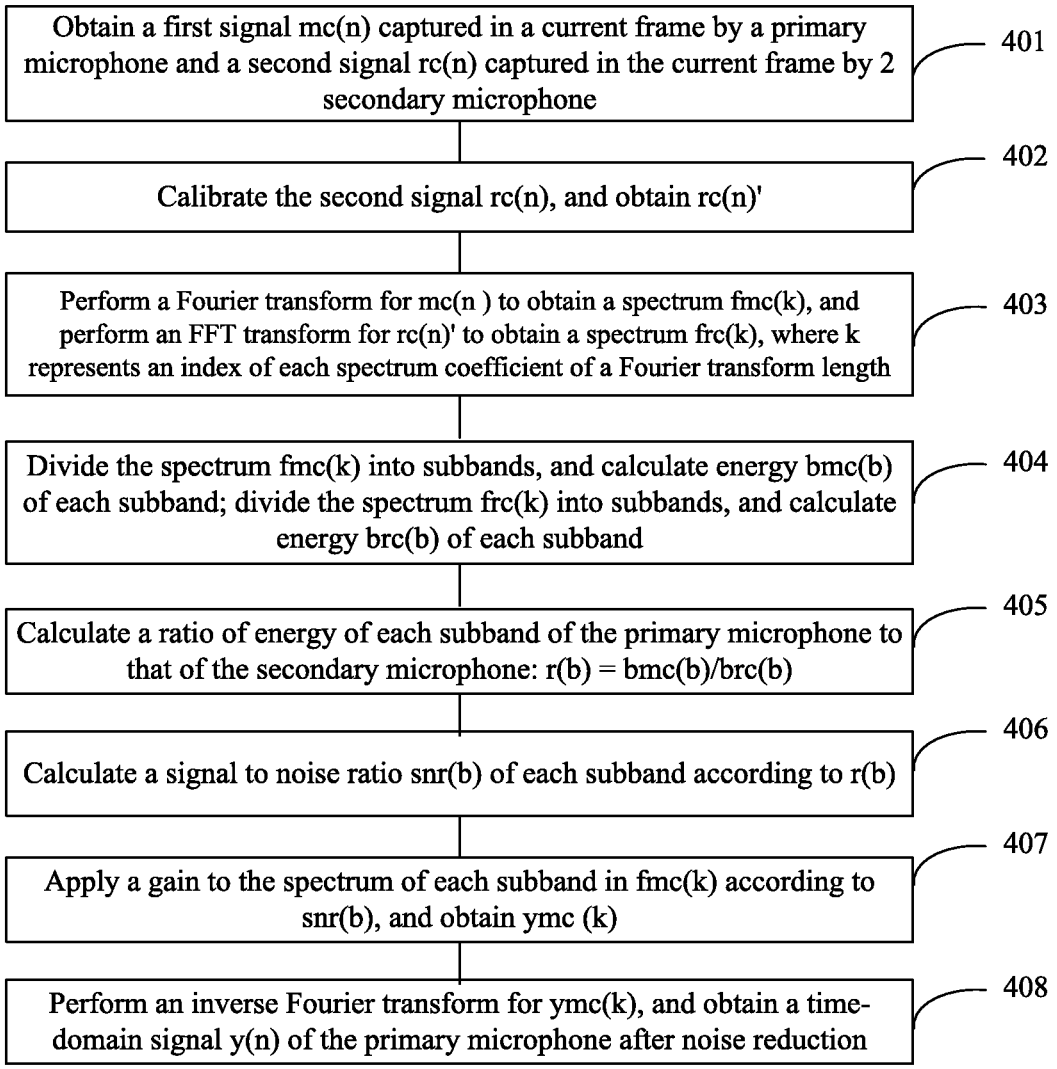
FIG. 4 is a flowchart of a noise reduction method according to an embodiment of the present invention.

As shown in FIG. 4, the noise reduction method may include the following:

401. Obtain a first signal mc(n) captured in a current frame by the primary microphone and a second signal rc(n) captured in the current frame by the secondary microphone.

402. Calibrate the second signal rc(n), and obtain rc(n)'.

For the specific calibration method, reference may be made to the foregoing embodiments.

403. Perform a Fourier transform on mc(n) to obtain a spectrum fmc(k), and perform a Fourier transform on rc(n)' to obtain a spectrum frc(k), where k represents an index of each spectrum coefficient of a Fourier transform length.

404. Divide the spectrum fmc(k) into subbands, and calculate energy bmc(b) of each subband; divide the spectrum frc(k) into subbands, and calculate energy brc(b) of each subband, where b represents an index of a subband.

Exemplarily, fmc(k) and frc(k) may be divided into subbands according to a psychoacoustic model, where energy of each subband represents a square sum of the spectrum coefficients in each subband.

405. Calculate a ratio of energy of each subband of the primary microphone to that of the secondary microphone: r(b)=bmc(b)/brc(b).

Exemplarily, when r(b) is greater than 1, it indicates that a large amount of wanted voice content exists; and when r(b) is close to 1, it indicates that a small amount of wanted voice content exists.

406. Calculate a signal to noise ratio snr(b) of each subband according to r(b).

Exemplarily, the signal to noise ratio snr(b) of each subband is obtained according to r(b) and a preset mapping relationship between r(b) and the signal to noise ratio snr(b) of each subband. For example, the mapping relationship may be a linear increment mapping. Given the linear mapping relationship, when a large amount of wanted voice content exists, the signal to noise ratio snr(b) is large, and when a small amount of wanted voice content exists, the signal to noise ratio snr(b) is small.

407. Apply a gain to the spectrum of each subband in fmc(k) according to snr(b), and obtain ymc(k).

Exemplarily, when the signal to noise ratio snr(b) is large, the applied gain is 1; and when the signal to noise ratio snr(b) is small, the applied gain is 0, that is, a wanted voice is reserved, and an environmental noise is removed.

408. Perform an inverse Fourier transform on ymc(k), and obtain a time-domain signal y(n) of the primary microphone after noise reduction.

Further, when sensitivity of the primary microphone is inconsistent with sensitivity of the secondary microphone, the noise reduction effect is affected. For example, when sensitivity of the secondary microphone is lower than sensitivity of the primary microphone, the capability of receiving environmental noises by the secondary microphone is lower than that of the primary microphone. In this case, characteristics of receiving environmental noises by the primary and secondary microphones approach characteristics of receiving wanted voices, and as a result, wanted voices cannot be distinguished from environmental noises.

With the noise reduction method provided by the embodiment of the present invention, consistency of sensitivity between the primary microphone and the secondary microphone is improved, and characteristics of receiving environmental noises by the primary and secondary microphones are more clearly distinguished from characteristics of receiving wanted voices, so that the noise reduction effect is improved, and better wanted voices are obtained.

Figure 5:
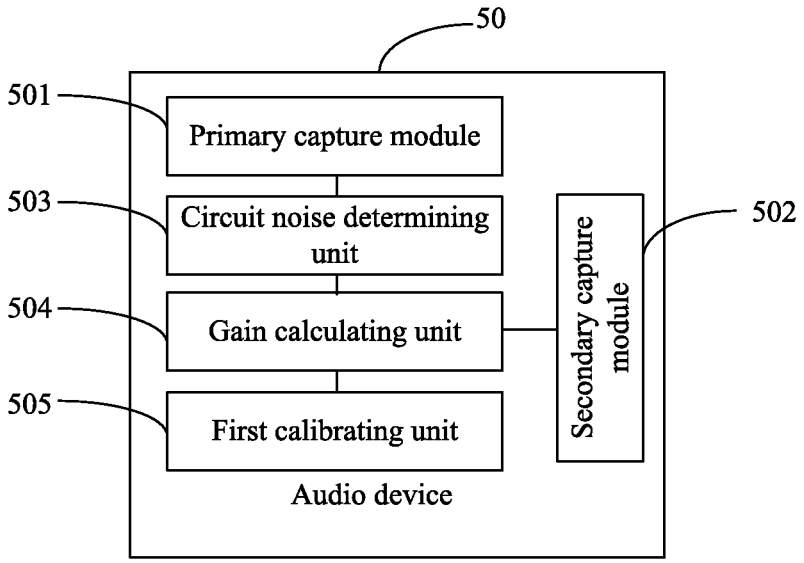
FIG. 5 is a schematic structural diagram of an audio device according to an embodiment of the present invention.

In one aspect, as shown in FIG. 5, an embodiment of the present invention provides an audio device 5050. The audio device 50 includes a primary capture module 501 and a secondary capture module 502, where the primary capture module 501 is configured to capture a first signal, and the secondary capture module 502 is configured to capture a second signal, and the audio device further includes:

a circuit noise determining unit 503, configured to determine whether the first signal captured by the primary capture module 501 is a circuit noise;

a gain calculating unit 504, configured to determine a first calibration gain according to the first signal and the second signal captured by the secondary capture module 502 when the first signal is not a circuit noise if the first signal has a stationary noise characteristic; and a first calibrating unit 505, configured to calibrate the second signal according to the first calibration gain, so that sensitivity of the primary capture module 501 is consistent with sensitivity of the secondary capture module 502.

Figure 6:
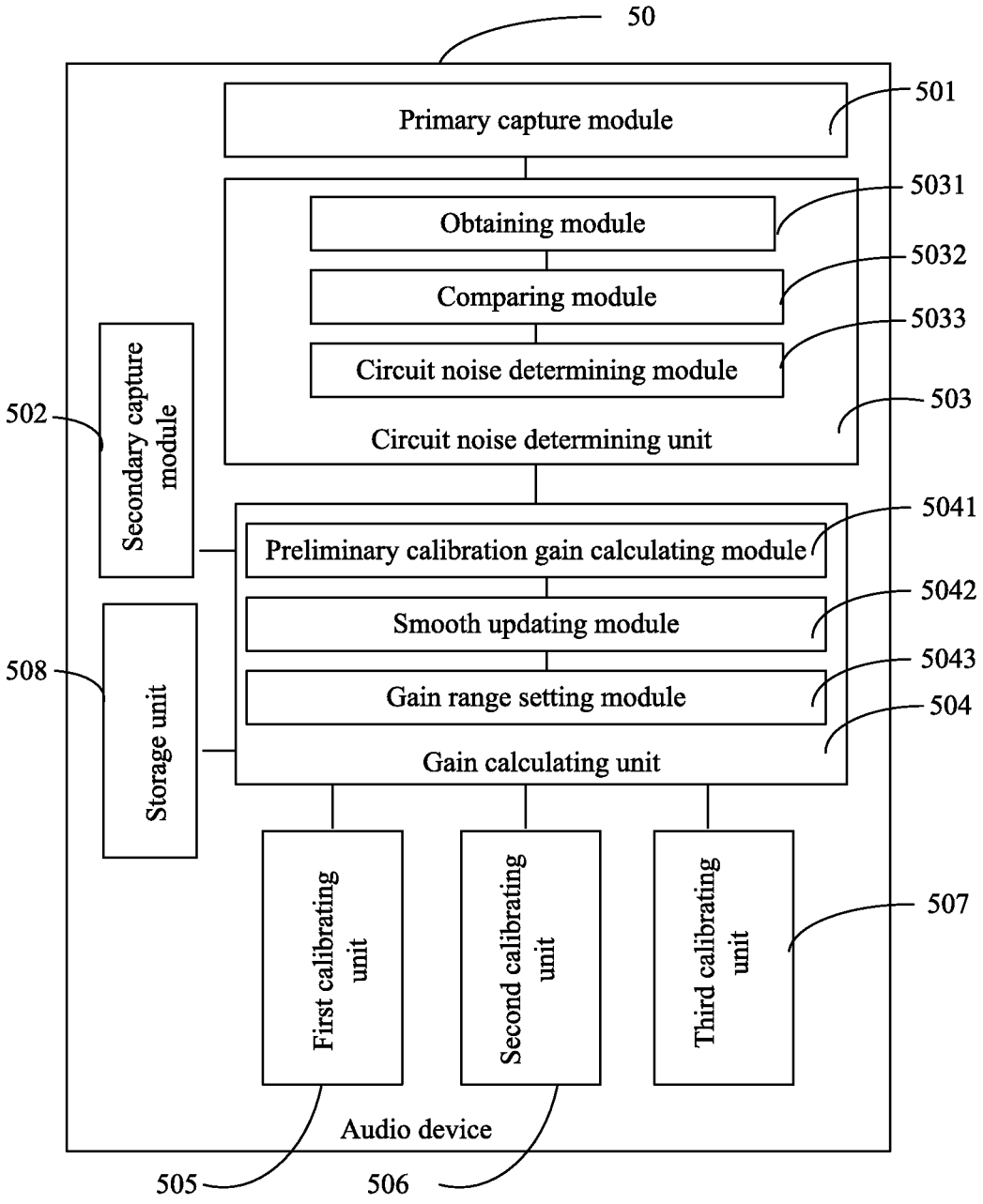
FIG. 6 is a schematic structural diagram of another audio device according to an embodiment of the present invention.

Further, as shown in FIG. 6, the circuit noise determining unit 503 includes:

an obtaining module 5031, configured to obtain a first characteristic value of the first signal;

a comparing module 5032, configured to compare the first characteristic value with a preset circuit noise threshold, where the first characteristic value includes: an average amplitude value, or a square root of average energy; and a circuit noise determining module 5033, configured to determine that the first signal is not a circuit noise if the first characteristic value is greater than the circuit noise threshold, or otherwise, determine that the first signal is a circuit noise.

Further, the gain calculating unit 504 specifically configured to: determine the first calibration gain according to a ratio of the first characteristic value of the first signal to a second characteristic value of the second signal.

Further, the gain calculating unit 504 includes:

a preliminary calibration gain calculating module 5041, configured to determine a preliminary calibration gain according to a ratio of the first characteristic value of the first signal to a second characteristic value of the second signal; and a smooth updating module 5042, configured to perform a smooth update on the determined preliminary calibration gain on a time axis according to a preset smoothing factor, and obtain the first calibration gain.

Further, the smooth updating module 5042 is specifically configured to: determine the first calibration gain according to a proportional relationship between a second calibration gain and the preliminary calibration gain, where if the current frame is the first frame, the second calibration gain is a preset value, or if the current frame is not the first frame, the second calibration gain is a first calibration gain determined in a previous frame of the current frame.

Further, the gain calculating unit 504 further includes: a gain range setting module 5043, configured to set a first calibration gain range according to the second calibration gain.

The gain updating module 5042 is specifically configured to: obtain an intermediate calibration gain according to the proportional relationship between the second calibration gain and the preliminary calibration gain; and if the intermediate calibration gain is within the first calibration gain range, use the intermediate calibration gain as the first calibration gain; or if the intermediate calibration gain is beyond the first calibration gain range, use a value, closest to the intermediate calibration gain, in the first calibration gain range as the first calibration gain.

Further, the first calibrating unit 505 is specifically configured to use a product of the second signal and the first calibration gain as the calibrated second signal.

Further, the audio device 50 further includes:

a second calibrating unit 506, configured to calibrate the second signal according to a second calibration gain when the first signal is a circuit noise, where if the current frame is the first frame, the second calibration gain is a preset value, or if the current frame is not the first frame, the second calibration gain is a first calibration gain determined in a previous frame of the current frame; and a third calibrating unit 507, configured to calibrate the second signal according to a second calibration gain when the first signal is not a circuit noise if the first signal does not have a stationary noise characteristic, where if the current frame is the first frame, the second calibration gain is a preset value, or if the current frame is not the first frame, the second calibration gain is a first calibration gain determined in a previous frame of the current frame.

Further, the audio device 50 may further include a storage unit 508, configured to store a second calibration gain, where if the current frame is the first frame, the second calibration gain is a preset value, or if the current frame is not the first frame, the second calibration gain is a first calibration gain determined in a previous frame of the current frame.

The audio device provided by the embodiment of the present invention includes a primary capture module and a secondary capture module. A first calibration gain is determined according to an obtained first signal captured in a current frame by the primary capture module and an obtained second signal captured in the current frame by the secondary capture module, and the second signal is calibrated according to the first calibration gain, so that calibration is implemented for the secondary capture module, consistency of sensitivity between the primary capture module and the secondary capture module is improved, further, the noise reduction effect is improved, and the problem of an undesired noise reduction effect caused by inconsistency of sensitivity between a primary capture module and a secondary capture module in the prior art is solved.

Figure 7:
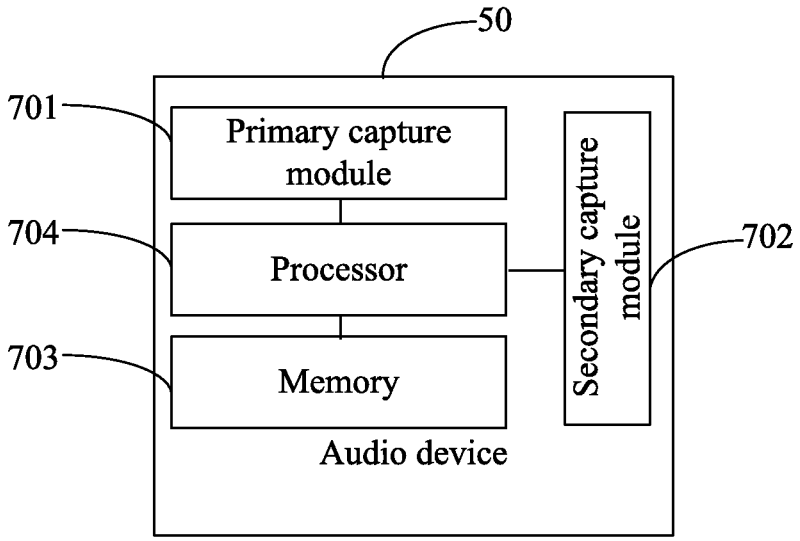
FIG. 7 is a schematic structural diagram of another audio device according to an embodiment of the present invention.

In one aspect, as shown in FIG. 7, an embodiment of the present invention further provides an audio device 50. The audio device 50 includes a primary capture module 701 and a secondary capture module 702, where the primary capture module 701 is configured to capture a first signal, the secondary capture module 702 is configured to capture a second signal, and the audio device 50 further includes:

a memory 703 and a processor 704, where the memory 703 is configured to store a group of codes, which are used to control the processor 704 to perform the following actions:

determining whether a first signal in a current frame is a circuit noise;

when the first signal is not a circuit noise, if the first signal has a stationary noise characteristic, determining a first calibration gain according to the first signal and a second signal in the current frame; and calibrating the second signal according to the first calibration gain.

Further, the processor 704 is specifically configured to:

obtain a first characteristic value of the first signal; compare the first characteristic value with a preset circuit noise threshold, where the first characteristic value includes: an average amplitude value, or a square root of average energy; and determine that the first signal is not a circuit noise if the first characteristic value is greater than the circuit noise threshold, or otherwise, determine that the first signal is a circuit noise.

Further, the processor 704 is specifically configured to determine the first calibration gain according to a ratio of the first characteristic value of the first signal to a second characteristic value of the second signal.

Further, the processor 704 is specifically configured to:

determine a preliminary calibration gain according to a ratio of the first characteristic value of the first signal to a second characteristic value of the second signal; and perform a smooth update on the determined preliminary calibration gain on a time axis according to a preset smoothing factor, and obtain the first calibration gain.

Further, the processor 704 is specifically configured to determine the first calibration gain according to a proportional relationship between a second calibration gain and the preliminary calibration gain, where if the current frame is the first frame, the second calibration gain is a preset value, or if the current frame is not the first frame, the second calibration gain is a first calibration gain determined in a previous frame of the current frame.

Further, the processor 704 is specifically configured to:

set a first calibration gain range according to the second calibration gain;

obtain an intermediate calibration gain according to the proportional relationship between the second calibration gain and the preliminary calibration gain; and if the intermediate calibration gain is within the first calibration gain range, use the intermediate calibration gain as the first calibration gain; or if the intermediate calibration gain is beyond the first calibration gain range, use a value, closest to the intermediate calibration gain, in the first calibration gain range as the first calibration gain.

Further, the processor 704 is specifically configured to use a product of the second signal and the first calibration gain as the calibrated second signal.

Further, the processor 704 is further configured to: calibrate the second signal according to a second calibration gain when the first signal is a circuit noise, where if the current frame is the first frame, the second calibration gain is a preset value, or if the current frame is not the first frame, the second calibration gain is a first calibration gain determined in a previous frame of the current frame;

or, calibrate the second signal according to a second calibration gain when the first signal is not a circuit noise if the first signal does not have a stationary noise characteristic, where if the current frame is the first frame, the second calibration gain is a preset value, or if the current frame is not the first frame, the second calibration gain is a first calibration gain determined in a previous frame of the current frame.

Further, the memory 703 may be further configured to store a second calibration gain, where if the current frame is the first frame, the second calibration gain is a preset value, or if the current frame is not the first frame, the second calibration gain is a first calibration gain determined in a previous frame of the current frame, and a preset value of the second calibration gain may be an initial value 1.

The audio device provided by the embodiment of the present invention includes a primary capture module and a secondary capture module. A first calibration gain is determined according to an obtained first signal captured in a current frame by the primary capture module and an obtained second signal captured in the current frame by the secondary capture module, and the second signal is calibrated according to the first calibration gain, so that calibration is implemented for the secondary capture module, consistency of sensitivity between the primary capture module and the secondary capture module is improved, further, the noise reduction effect is improved, and the problem of an undesired noise reduction effect caused by inconsistency of sensitivity between a primary capture module and a secondary capture module in the prior art is solved.

It may be clearly understood by persons skilled in the art that, for the purpose of convenient and brief description, for a detailed working process of the foregoing devices and unit, reference may be made to a corresponding process in the foregoing method embodiments, and details are not described herein again.

In the several embodiments provided in the present application, it should be understood that the disclosed devices and method may be implemented in other manners. For example, the described devices embodiment is merely exemplary. For example, the unit division is merely logical function division and may be other division in an actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the devisees or units may be implemented in electronic, mechanical, or other forms.

The units described as separate parts may or may not be physically separate, and parts displayed as units may or may not be physical units, may be located in one position, or may be distributed on a plurality of network units. A part or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit. The integrated unit may be implemented in a form of hardware, or may be implemented in a form of hardware plus a software functional unit.

When the foregoing integrated unit is implemented in a form of a software functional unit, the integrated unit may be stored in a computer-readable storage medium. The software functional unit is stored in a storage medium and includes several instructions for instructing a computer device (which may be a personal computer, a server, or a network device) to perform a part of the steps of the methods described in the embodiments of the present invention. The foregoing storage medium includes: any medium that can store program code, such as a USB flash drive, a removable hard disk drive, a read-only memory (Read-Only Memory, ROM for short), a random access memory (Random Access Memory, RAM for short), a magnetic disk, or an optical disc.

Finally, it should be noted that the foregoing embodiments are merely intended for describing the technical solutions of the present invention rather than limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, as long as such modifications or replacements do not cause the essence of corresponding technical solutions to depart from the scope of the technical solutions of the embodiments of the present invention.

What is claimed is:

1. A sensitivity calibration method for use with an audio device that comprises a primary capture module and a secondary capture module, the method comprising:

determining whether a first signal captured in a current frame by the primary capture module is circuit noise;

when the first signal is not circuit noise, if the first signal has a stationary noise characteristic, determining a first calibration gain according to the first signal and a second signal captured in the current frame by the secondary capture module; and calibrating the second signal according to the first calibration gain, so that sensitivity of the primary capture module is consistent with sensitivity of the secondary capture module;

wherein the determining a first calibration gain according to the first signal and a second signal captured in the current frame by the secondary capture module comprises:

determining a preliminary calibration gain according to a ratio of a first characteristic value of the first signal to a second characteristic value of the second signal; and determining the first calibration gain according to a proportional relationship between a second calibration gain and the preliminary calibration gain, wherein if the current frame is a first frame, the second calibration gain is a preset value, or if the current frame is not the first frame, the second calibration gain is a first calibration gain determined in a previous frame of the current frame.

2. The method according to claim 1, wherein determining whether the first signal captured by the primary capture module is circuit noise comprises:

obtaining the first characteristic value of the first signal, wherein the first characteristic value comprises an average amplitude value or a square root of average energy;

comparing the first characteristic value with a preset circuit noise threshold, and if the first characteristic value is greater than the circuit noise threshold, determining that the first signal is not circuit noise; and if the first characteristic value is not greater than the circuit noise threshold, determining that the first signal is circuit noise.

3. The method according to claim 1, wherein calibrating the second signal according to the first calibration gain comprises using a product of the second signal and the first calibration gain as the calibrated second signal.

4. The method according to claim 1, wherein, before determining the first calibration gain according to a proportional relationship between a second calibration gain and the preliminary calibration gain, the method further comprises setting a first calibration gain range according to the second calibration gain; and wherein determining the first calibration gain according to a proportional relationship between a second calibration gain and the preliminary calibration gain comprises:

obtaining an intermediate calibration gain according to the proportional relationship between the second calibration gain and the preliminary calibration gain;

if the intermediate calibration gain is within the first calibration gain range, using the intermediate calibration gain as the first calibration gain; and if the intermediate calibration gain is not within the first calibration gain range, using a value closest to the intermediate calibration gain in the first calibration gain range as the first calibration gain.

5. The method according to claim 1, further comprising calibrating the second signal according to a second calibration gain when the first signal is circuit noise or when the first signal is not circuit noise and the first signal does not have a stationary noise characteristic, wherein the second calibration gain is a preset value when the current frame is a first frame the second calibration gain is a first calibration gain determined in a previous frame of the current frame when the current frame is not the first frame.

6. A sensitivity calibration method for use with an audio device that comprises a primary capture module and a secondary capture module, the method comprising:

using the primary capture module to capture a first signal in a current frame, the first signal having a stationary noise characteristic;

using the secondary capture module to capture a second signal in the current frame;

determining that the first signal is not circuit noise;

determining a first calibration gain according to the first signal and the second signal; and calibrating the second signal according to the first calibration gain, so that sensitivity of the secondary capture module is consistent with sensitivity of the primary capture module;

wherein the determining a first calibration gain according to the first signal and a second signal module comprises:

determining a preliminary calibration gain according to a ratio of a first characteristic value of the first signal to a second characteristic value of the second signal; and determining the first calibration gain according to a proportional relationship between a second calibration gain and the preliminary calibration gain, wherein if the current frame is the first frame, the second calibration gain is a preset value, or if the current frame is not the first frame, the second calibration gain is a first calibration gain determined in a previous frame of the current frame.

7. The method according to claim 6, wherein determining that the first signal captured is not circuit noise comprises:

obtaining the first characteristic value of the first signal, wherein the first characteristic value comprises an average amplitude value or a square root of average energy;

comparing the first characteristic value with a preset circuit noise threshold; and determining that the first characteristic value is greater than the circuit noise threshold.

8. The method according to claim 6, wherein determining the first calibration gain according to the first signal and the second signal further comprises:

performing a smooth update on the determined preliminary calibration gain on a time axis according to a preset smoothing factor; and obtaining the first calibration gain.

9. An audio device, comprising:

a primary capture module, configured to capture a first signal during a current frame;

a secondary capture module, configured to capture a second signal during the current frame;

a processor connected to the primary capture module and to the secondary capture module; and a non-transitory computer readable medium connected to the processor and storing program modules executable by the processor, the modules including:

a circuit noise determining unit, configured to determine whether the first signal is circuit noise;

a gain calculating unit, configured to determine a first calibration gain according to the first signal and the second signal when the first signal is not circuit noise if the first signal has a stationary noise characteristic; and a first calibrating unit, configured to calibrate the second signal according to the first calibration gain, so that sensitivity of the secondary capture module is consistent with sensitivity of the primary capture module;

wherein the gain calculating unit comprises a preliminary calibration gain calculating module and a smooth updating module;

wherein the preliminary calibration gain calculating module, configured to determine a preliminary calibration gain according to a ratio of a first characteristic value of the first signal to a second characteristic value of the second signal; and wherein the smooth updating module, configured to determine the first calibration gain according to a proportional relationship between a second calibration gain and the preliminary calibration gain, wherein if the current frame is the first frame, the second calibration gain is a preset value, or if the current frame is not the first frame, the second calibration gain is a first calibration gain determined in a previous frame of the current frame.

10. The device according to claim 9, wherein the circuit noise determining unit comprises:

an obtaining module, configured to obtain the first characteristic value of the first signal;

a comparing module, configured to compare the first characteristic value with a preset circuit noise threshold, wherein the first characteristic value comprises an average amplitude value or a square root of average energy; and a circuit noise determining module, configured to determine that the first signal is not circuit noise when the first characteristic value is greater than the circuit noise threshold and to determine that the first signal is circuit noise when the first characteristic value is not greater than the circuit noise threshold.

11. The device according to claim 9, wherein the gain calculating unit further comprises a gain range setting module, configured to set a first calibration gain range according to the second calibration gain; and wherein the gain updating module is configured to obtain an intermediate calibration gain according to the proportional relationship between the second calibration gain and the preliminary calibration gain, to use the intermediate calibration gain as the first calibration gain when the intermediate calibration gain is within the first calibration gain range and to use a value closest to the intermediate calibration gain in the first calibration gain range as the first calibration gain when the intermediate calibration gain is not within the first calibration gain range.

12. The device according to claim 9, wherein the first calibrating unit is configured to use a product of the second signal and the first calibration gain as the calibrated second signal.

13. The device according to claim 9, further comprising a second calibrating unit, configured to calibrate the second signal according to a second calibration gain when the first signal is a circuit noise, wherein the second calibration gain is a preset value when the current frame is a first frame and the second calibration gain is a first calibration gain determined in a previous frame relative to the current frame when the current frame is not the first frame.

14. The device according to claim 9, further comprising a third calibrating unit, configured to calibrate the second signal according to a second calibration gain when the first signal is not circuit noise if the first signal does not have a stationary noise characteristic, wherein if the current frame is a first frame, the second calibration gain is a preset value, or if the current frame is not the first frame, the second calibration gain is a first calibration gain determined in a previous frame of the current frame.

* * * * *